US005544781A

United States Patent [19]

Mattesky

[11] Patent Number: 5,544,781

[45] Date of Patent: Aug. 13, 1996

[54] RECEPTACLE CONSTRUCTION FOR SUPPORTING A COLLAPSIBLE BAG

[75] Inventor: Henry Mattesky, Cedar Grove, N.J.

[73] Assignee: Seymour Housewares Corporation, Seymour, Ind.

[21] Appl. No.: 180,123

[22] Filed: Jan. 14, 1994

[51] Int. Cl.[6] ..... A63B 55/04

[52] U.S. Cl. ..... 220/404; 220/403; 248/97

[58] Field of Search ..... 220/404, 403; 248/97, 102

[56] References Cited

U.S. PATENT DOCUMENTS

| | | | |
|---|---|---|---|
| 3,352,520 | 11/1967 | Bumgarner et al. | 220/404 |
| 4,027,774 | 6/1977 | Cote | 220/404 |
| 4,356,933 | 11/1982 | Connolly | 220/404 |
| 4,585,283 | 4/1986 | Redmon et al. | 220/404 |
| 4,589,570 | 5/1986 | Auten | 220/404 |
| 4,642,934 | 2/1987 | Carlson et al. | 220/404 |
| 4,901,959 | 2/1990 | Stagz | 220/404 |
| 4,946,118 | 8/1990 | Hastings | 220/404 |

*Primary Examiner*—Joseph M. Moy
*Attorney, Agent, or Firm*—King & Schickli

[57] ABSTRACT

A rectangular bag support frame is formed of extruded thermoplastic pipes and molded thermoplastic Y-joints. The joints and pipes form upper and lower parallel frames with a bag receiving cavity. The upper joints each have radially outwardly extending coplanar flanges forming a channel region for capturing the draw string edge region of a collapsible bag to be temporarily secured to the upper frame. The bag is supported by the frame at the bag edge regions which are wrapped about the upper frame with the draw string loop captured by the joint flanges. The draw string is then tightened to secure the bag upper end to the upper frame while the bag contained in the frame cavity is filled, the upper frame keeping the bag open for filling.

14 Claims, 4 Drawing Sheets

RECEPTACLE CONSTRUCTION FOR SUPPORTING A COLLAPSIBLE BAG

FIELD OF THE INVENTION

This invention relates to receptacles, typically frames, for supporting and holding collapsible bags in an open state to permit filling the bag with objects.

DISCUSSION OF THE PRIOR ART

One prior art frame construction comprises a plurality of plastic extruded pipes secured at their ends by joint elements. Such plastic pipes and joint elements are used to fabricate a number of different kinds of structures including furniture and the receptacles of interest herein. The joint elements are Y-shaped with orthogonal legs, each leg for receiving the end of a different pipe section. The pipe sections typically are straight. Because such pipes and joint elements are commercially available for a number of different uses, bag supporting frame constructions using such pipes and joint elements are limited to their commercially available configuration.

In a prior art bag receiving receptacle, the straight pipes and Y-shaped joint elements form a rectangular upright framework with usually rectangular bottom and upper frames. A bag to be supported is placed within the framework with the open edge of the bag folded over the upper frame of the receptacle. The bag has a draw string at its open end. The draw string may then be tightened around the step between the bottom edge of the Y-shaped joint and the vertical pipe inserted therein, an attempt to secure the bag to the receptacle at the upper frame as the bag receives objects, the bag being held open by the receptacle upper frame. Such a receptacle is used, for example, in the laundry industry to sort laundry. However, a problem with this construction is that the open edge of the bag tends to slip off the upper frame causing the bag to collapse. Such bags in the laundry industry may be fiber netting or woven fibers such as cotton or synthetic fibers. Such bags without the receptacle are not self supporting and immediately collapse without a rigid support.

SUMMARY OF THE INVENTION

A receptacle construction according to the present invention for supporting a collapsible bag, having an opening at one end, the bag having an annular edge region with draw string receiving means at the said end and a draw string in the receiving means for selectively closing the opening upon drawing the draw string. Said construction comprises a receptacle defining a cavity for receiving the bag therein and including rim means for receiving at least the edge region. The rim means receives and supports the edge region while the bag is received in the cavity permitting the bag to be in an open state so the bag can receive objects therein.

The rim means or edge region receiving means for releasably receive the edge region including the draw string receiving means about the receptacle when the bag is received in the cavity, the edge region including means for selectively releasably securing the edge region to the receptacle while simultaneously maintaining the bag in the open state.

In accordance with one embodiment, the receptacle has a top and a bottom, an opening being adjacent to the top of the receptacle, the cavity and said opening defining a common axis extending in a direction from the top to bottom, the edge region receiving means comprising at least one projection having a planar surface extending transversely outwardly from the axis.

In accordance with a variation of this embodiment, in place of a planar surface extending outwardly, the rim means comprise an inwardly directed slot or groove.

In accordance with a further embodiment, the receptacle comprises a frame including an annular bottom frame member (which may be a composite of a plurality of sub-members) and a plurality of spaced frame posts upstanding from the bottom member, the rim means (which may be a composite of a plurality of sub-members) comprising an annular top member secured to the posts distal the bottom frame member, the at least one projection comprising a plurality of spaced projections extending radially outwardly from the rim means.

IN THE DRAWING

DETAILED DISCUSSION OF THE DRAWINGS

Figure 1:
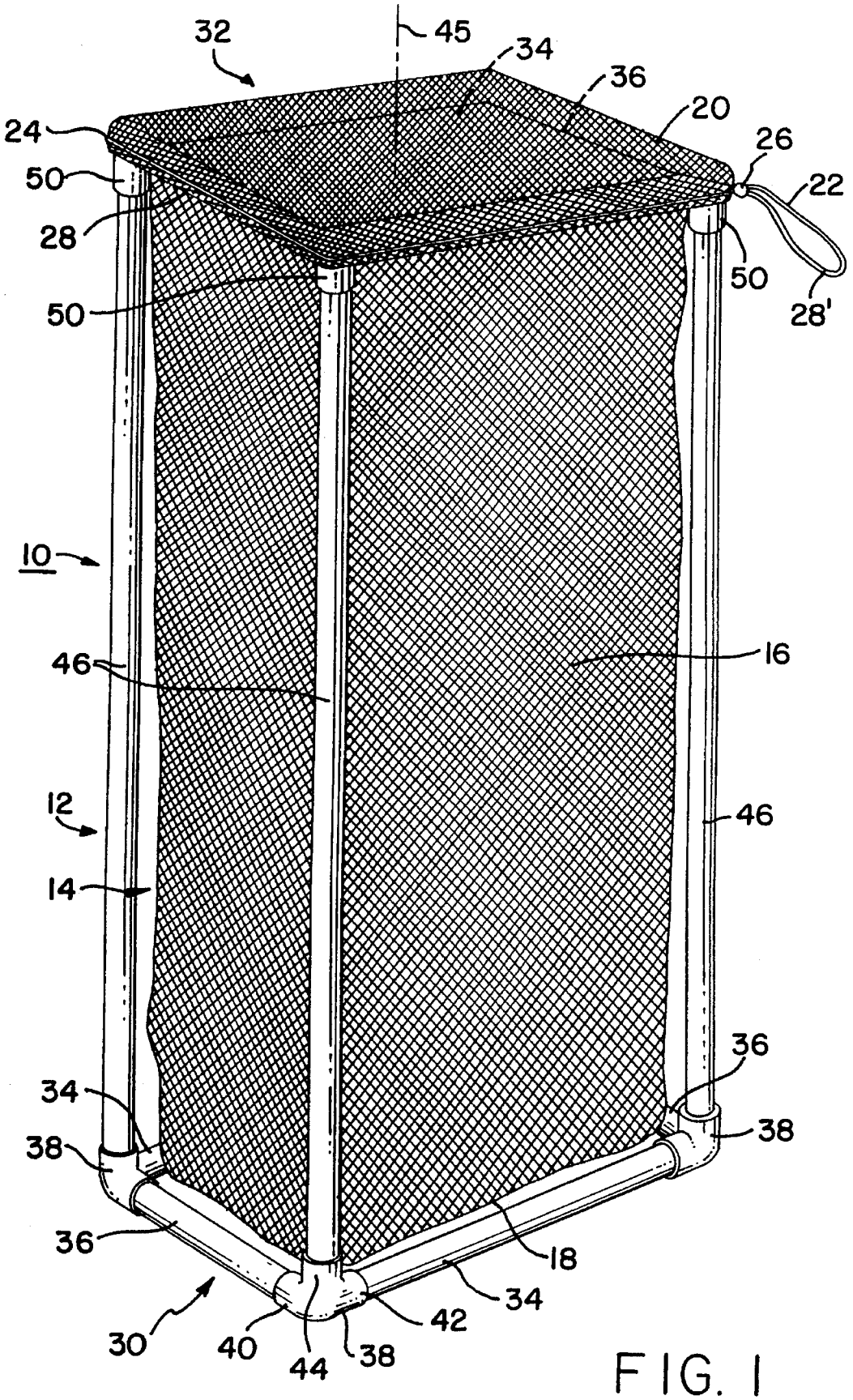
FIG. 1 is an isometric view of a receptacle construction and laundry bag received thereto according to one embodiment of the present invention.

In the various Figures, like reference numerals refer to like parts. In FIG. 1, assembly 10 comprises a receptacle 12 and an open mesh net bag 14 which is supported by receptacle 12 in an open bag state for receiving objects, e.g., laundry in this example. The bag 14 comprises a commercially available open net mesh made of cotton or synthetic fibers and is collapsible without the presence of the receptacle 12. The open net bag is shown only for illustration and may be any kind of commercially collapsible bag regardless its material and may comprise thermoplastic film, woven fibers or open net mesh as shown. All such bags have a commonality in that they collapse without a rigid support structure. The rigid support structure holds the bag open in an upright state so the bag may be conveniently filled, the bag in its collapsed state being awkward to fill.

The bag 14 comprises a body 16, typically elongated, with an enclosed bottom 18 and an open top 20. The bag 14 includes a draw string 22 encased in a conduit 24 at edge region 25. A locking sleeve 26 is slid along the draw string 22 to tighten or loosen the loop 28 of the string. A secondary loop 28' is formed by sleeve 26 such that as loop 28 is tightened by reducing its size, the loop 28' is enlarged and vice versa. The drawing of the string through the sleeve 26 then effects the size of the loop 28 depending upon the direction of the drawing action through the sleeve. The bag 14 so described is commercially available.

The receptacle 12 comprises a bottom rectangular frame 30 and an upper like dimensioned frame 32. The upper and bottom frames lie in parallel planes. Bottom frame 30 comprises a pair of opposite like dimensioned front and rear pipes 34 and a pair of shorter like dimensioned pipes 36. Nevertheless, said pipes 34 and 36 may, if desired, be equidimensional. The pipes are interconnected by four corner joints 38 (only three being shown) which are identical and only one, therefore, will be described for purposes of illustration.

Joint 38 comprises three hollow core legs 40, 42 and 44, which may be identical, oriented in three corresponding orthogonal directions. The joint 38 is molded thermoplastic and preferably is PVC or other rigid thermoplastic material. Leg 42 core receives an end of pipe 34 and leg 40 core receives an end of pipe 36. These legs and pipes form the bottom frame 30 with the legs 44 of all of the joints upstanding in a vertical direction relative to gravity parallel to axis 45. The pipes and joints may be secured by fasteners or an adhesive.

A set of four upstanding pipes 46 of identical length are each inserted in the hollow core of the corresponding upstanding leg 44 of each joint 38. In this embodiment, all of the pipes are preferably formed of extruded thermoplastic circular cylindrical pipes which are cut to length. The pipes may be polyvinylchloride (PVC) for example, and are commercially available.

Upper frame 32 also comprises like opposite pairs of pipes 34 and 36 and a set of four like joints 50. Joints 50, FIGS. 2 and 3, have three orthogonal legs 52, 54 and 56, which preferably are identical. These joints also have hollow cores for receiving the corresponding pipe section ends. Leg 56 receives an end of a pipe 34 and leg 54 receives an end of pipe 36. Leg 52 receives an end of pipe 46. Joints 50 legs 52 thus join the vertical pipes 46 to the upper frame 32. The joints 50 as described thus far may be identical to the joints 38 of the bottom frame.

Figure 3A:
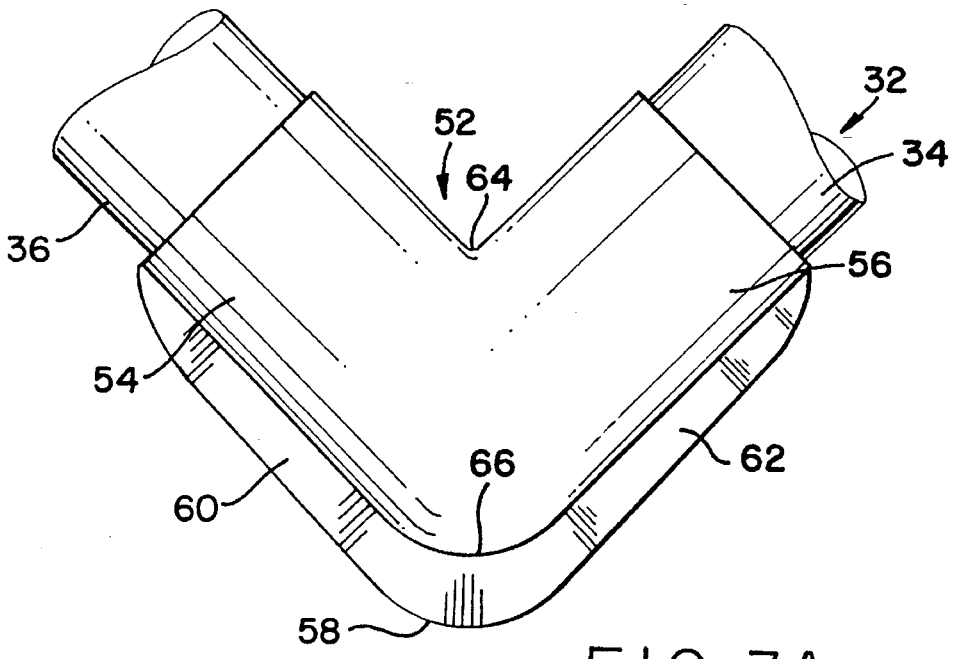
FIG. 3A is a plan view of the corner construction of the receptacle of the embodiment of FIGS. 1 and 2 without the bag in place.
Figure 3B:
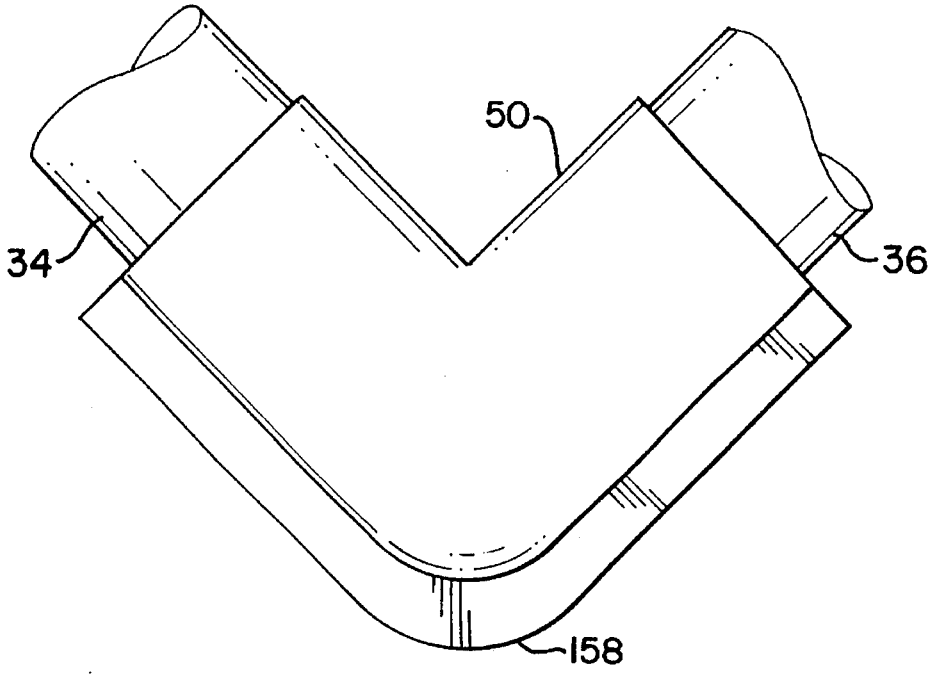
FIG. 3B is another plan view of the corner construction of the receptacle of the embodiment of FIGS. 1 and 2 without the bag in place.
Figure 3C:
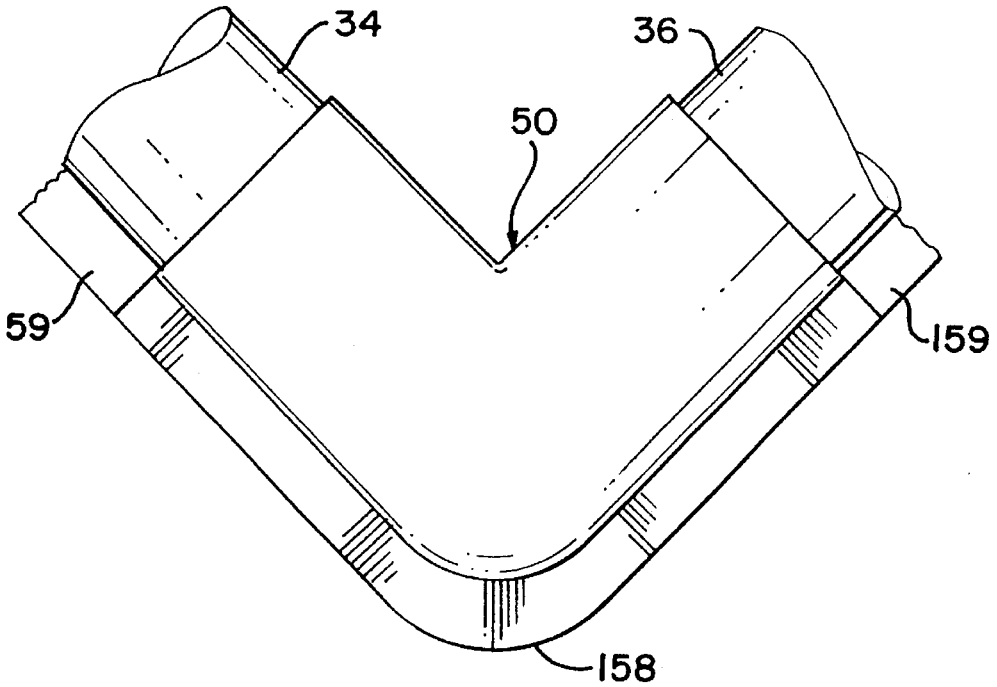
FIG. 3C is yet another a plan view of the corner construction of the receptacle of the embodiment of FIGS. 1 and 2 without the bag in place.

However, joints 50 differ significantly from joints 38. As shown in FIGS. 3A, 3B, and 3C molded integral with each joint 50, is a flange 58. The flange 58 projects radially outwardly relative to axis 45, FIG. 1, on each joint 50.

In FIG. 3A, flange 58 comprises two coplanar continuously extending integral legs 60 and 62. The joint 50 has an inner corner 64 and an outer corner 66. The flange 58 wraps about outer corner 66 in a plane parallel to the plane of the upper frame 32. Thus there is a flange 58 at each corner of the upper frame 32.

In FIG. 3B flange 158 projects substantially equidistantly from the outer surface of joint 50.

In FIG. 3C pipes 34 and 36 carry separate flanges 59 and 159 which are substantially continuations of flange 158. These flanges 59 and 159 may, but need not extend along the entire length of the pipe carrying them. Flange 59 may be present in the absence of flange 159 and vice versa.

Figure 4A:
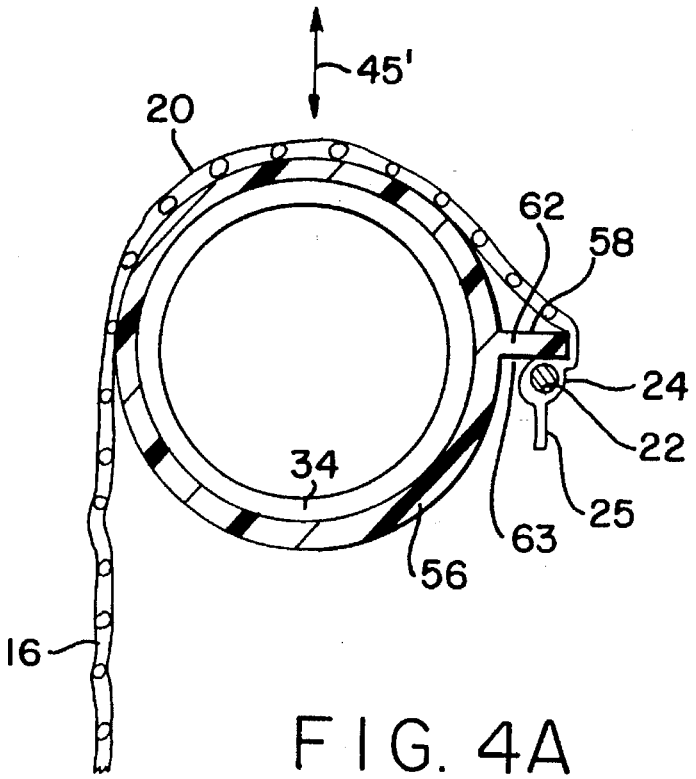
FIG. 4A is a sectional view of the embodiment of FIG. 2 taken along lines 4—4.

As shown in FIG. 4A, the flange 58 may be somewhat centrally of the leg 56 in the vertical directions 45' parallel to axis 45. This is not critical. The upper frame thus forms a rim which defines an upper opening through which the upper end of the bag 16 passes. The bag upper end is wrapped over the rim and the frame 32.

Figure 4B:
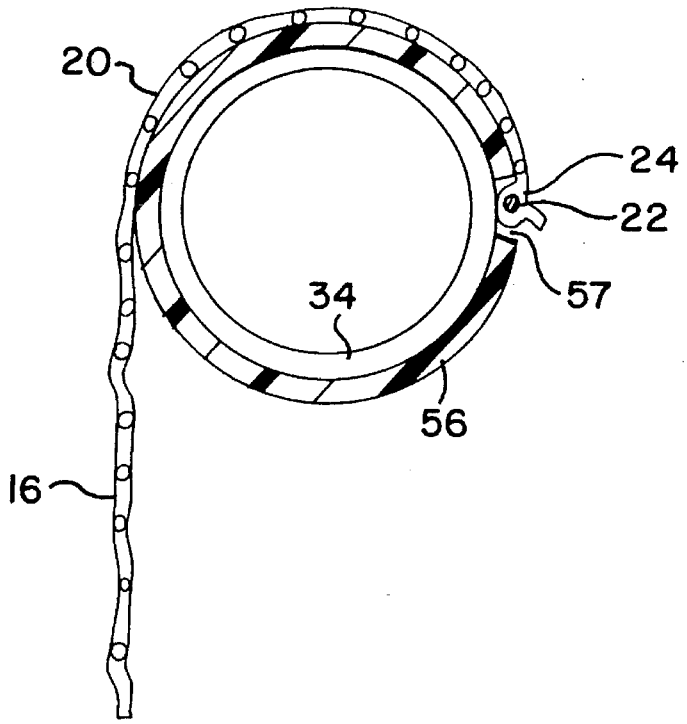
FIG. 4B is a sectional view of a further embodiment of FIG. 2 taken along lines 4—4.

In yet another embodiment as shown in FIG. 4B, in place of flange 58 there is a groove or slot 57 which holds the edge region.

Figure 2:
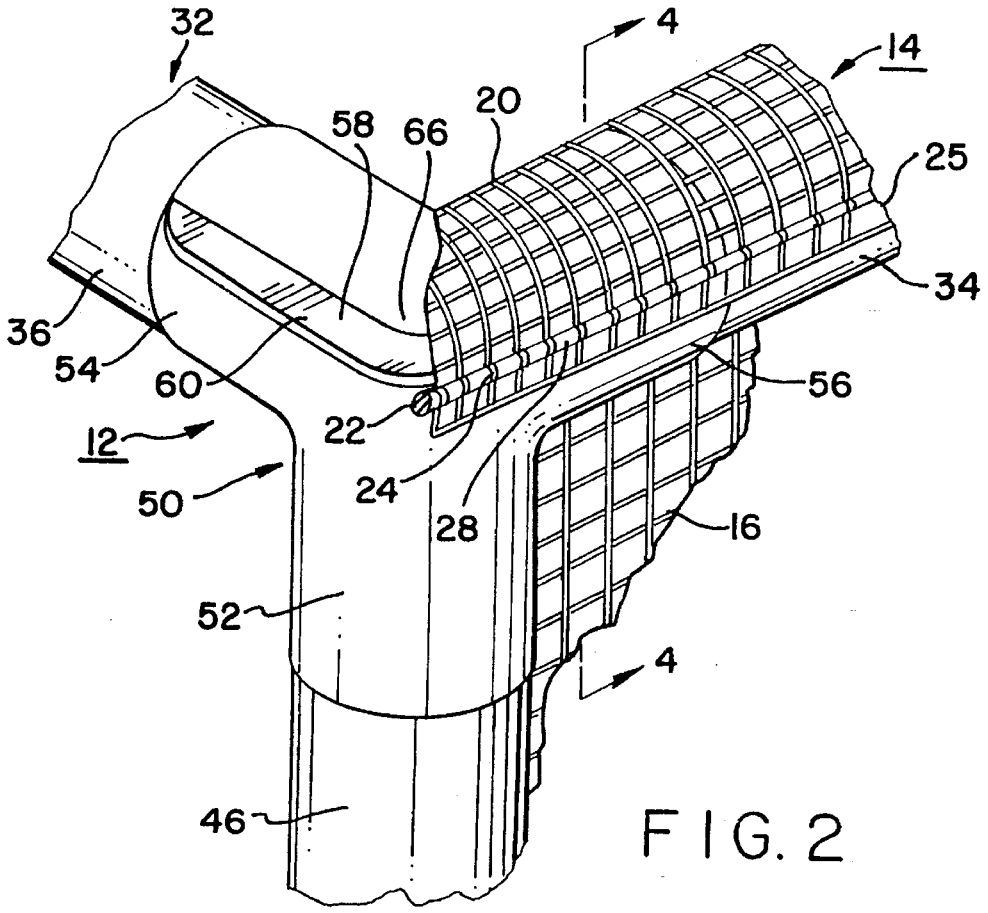
FIG. 2 is a more detailed sectional and fragmentary isometric view of an upper corner portion of the construction of FIG. 1.

In FIGS. 2, 3 and 4, in operation, the top 20 of the bag 16 is slipped through and wrapped over the upper frame 32. The remaining bag portion is inserted into the cavity of the receptacle along axis 45. In the alternative, because the receptacle is an open frame, the bag 16 could be slipped into the receptacle cavity transversely and the bag top pulled up through and over the frame 32. The bag edge region 25 containing the draw string 22 loop 28 is urged over the flange 58 at each corner into the channel region 63 formed by the underside of flange 58 and the corresponding sides of the joint 50 legs 54 and 56. Flange 58 legs 60 and 62 form a channel region 63 with legs 54 and 56 at each joint corner. The channel regions 63 of all four corners are coplanar and receive the bag edge region 25 and the draw string loop 28. With the edge regions so inserted, the draw string 22 is drawn tight enlarging loop 28' and reducing loop 28 accordingly. This action, FIG. 4, forces the edge region 25 of the bag 16 into the channel region 63 beneath the flange 58 locking the bag top 20 to the upper frame 32. Thus, the bag 16 can not easily slip off the frame 32 as the bag is loaded providing added forces on the edge regions as in prior art structures.

The flange 58 need project sufficiently beyond the joint 50 to form a channel region 63 sufficiently deep to receive and lock the edge region 25 in place. The flanges 58 are located in this embodiment at the corners as this is the region where the loop 28 exerts its optimum forces against the frame because the frame has right angle corners. However, in other alternative embodiments where the receptacle is circular and not rectangular with no definable corners, using circular pipe frame sections for example, in the alternative instead of straight pipe sections, the flanges may project from the pipe sections or the joints.

In other implementations the channel regions 63 may be formed by an embedded channel formed in the external wall surface of each joint. In this case such channel regions need an upper side wall which will function similarly as flange 58, that is, have an upper side wall that is at least coplanar with the frame 32 or downwardly inclined as it extends radially outwardly from the receptacle in order to capture the bag edge region 25 as the loop 28 is tightened.

Also, in an alternative implementation, other means may be provided internal the upper frame for receiving the bag edge region 25 such as periodically spaced hooks extending internally from the upper frame about and in the upper opening formed by the upper frame at the egress of the bag 16. Such hooks receive the bag edge regions and permit the draw string to be tightened thereagainst to secure the bag in place while maintaining the bag in the open object receiving state. Such hooks may be molded integrally with either the joints or pipes.

In further implementations, the flanges may be continuous about the upper frame instead of in periodically spaced locations, especially in a circular receptacle.

While planar flanges 58 are shown, other types of projections may be used which lie generally in a plane parallel to the plane of the frame 32. Such projections may be pin-like in structure and will perform similarly as the flanges 58. Also, the flanges 58 need not wrap about the entire joint adjacent to each joint leg 54 and 56 but may be locally limited to the external corner 66 of each joint 50 or project only from each joint leg as a separate projection.

Various modifications will occur to those of ordinary skill and it is intended that the scope of the invention is as defined by the appended claims and not the embodiments described.

What is claimed is:

1. A receptacle construction for supporting a collapsible bag having a first opening at a bag end, said bag having an annular edge region with draw string receiving means at said end and a draw string in said receiving means for selectively closing the opening upon drawing the draw string, said construction comprising:

a receptacle defining a cavity for receiving the bag therein and including rim means defining a second opening for receiving at least said edge region, said rim means for receiving and supporting the edge region while said bag is received in said cavity permitting the first opening to be in an open state coincident with said second opening so the bag can receive objects therein through said first opening;

edge region receiving means coupled to the receptacle adjacent to the rim means for releasably receiving and capturing the edge region including the draw string receiving means about the second opening when the bag is received in said cavity, said edge region receiving means including means for selectively releasably securing the edge region to the receptacle while simultaneously maintaining the first opening in the open state; and said receptacle having a top and a bottom, said second opening being adjacent to the top of the receptacle, said cavity and second opening defining a common axis extending in a direction from the top to bottom said edge region receiving means comprising spaced flanges having a planar surface extending transversely outwardly from said axis.

2. The construction of claim 1 wherein the receptacle comprises a frame including an annular bottom frame member and a plurality of spaced frame posts upstanding from the bottom member, said rim means comprising an annular top member secured to said posts distal said bottom frame member, wherein the bottom and top frame members each comprise a first plurality pipe sections and a second plurality of joint sections, each joint section for securing an end portion of the pipe sections thereto, each said point sections of said top frame member including said spaced flanges secured thereto, each said joint sections for further securing said posts thereto.

3. The construction of claim 2 wherein the joint sections each comprise a plurality of legs oriented in corresponding different orientations and defining an interior corner and an exterior corner, said legs each having a hollow core for receiving a different pipe section end portion therein, said spaced flanges being secured adjacent to said exterior corner of each of the joint sections of said top frame member.

4. The construction of claim 3 wherein the joint sections are Y-shaped having three legs oriented in orthogonal directions.

5. The construction of claim 1 wherein said edge region receiving means includes means arranged so that the edge region is releasably locked to the receptacle at said spaced locations upon drawing the draw string to a partially closed state while simultaneously maintaining the first opening in the open state.

6. The construction of claim 4 wherein the top and bottom frame members are square and lying in parallel planes, the spaced flanges at each joint comprising a planar flange parallel to the plane of the top frame member.

7. The construction of claim 4 wherein the spaced flanges comprise L-shaped, coplanar flanges with each said flange extending about said exterior corner of its corresponding joint section.

8. The construction of claim 5 wherein the cavity and second opening have a common axis, said edge region receiving means comprising channel means secured to the receptacle adjacent to said rim means external said cavity and second opening, said channel means having a bottom wall and at least one side wall, said side wall extending transversely outwardly from said axis, said bottom wall and side wall for receiving said bag annular edge region.

9. A receptacle construction for supporting a collapsible bag having a first opening at a bag end, said bag having an annular edge region with draw string receiving means at said end and a draw string in said receiving means for selectively closing the opening upon drawing the draw string, said construction comprising:

a hollow receptacle defining a cavity for receiving the bag therein and including annular rim means defining a second opening for receiving at least said edge region, said rim means for receiving the edge region while said bag is received in said cavity for permitting the first opening to be in an open state coincident with said second opening so the bag can receive objects therein through said first opening; and multiple edge region receiving means secured at spaced locations to the receptacle at said rim means for releasably receiving the edge region including the draw string receiving means external and about the receptacle, said multiple edge region receiving means being arranged so that the bag edge region is releasably secured to the receptacle at said spaced locations upon drawing the draw string to a partially closed state while simultaneously maintaining the first opening in the open state when the bag is received in said receptacle, said edge region receiving means comprising a planar surface extending transversely outwardly from said rim means.

10. The construction of claim 9 wherein the receptacle comprises a plurality of pipes and joints, said joints forming bottom and top frames with a corresponding separate portion of said multiple pipes, said edge region receiving means being secured to said top frame.

11. The construction of claim 10 wherein said rim means comprises an annular member, said edge region receiving means comprising a plurality of said spaced flanges secured to said annular member external said second opening.

12. The joint sections of the top frame members of claim 2.

13. The joint sections of the top frame members of claim 3.

14. The joint sections of the top frame members of claim 4.

* * * * *

UNITED STATES PATENT AND TRADEMARK OFFICE

CERTIFICATE OF CORRECTION

PATENT NO. : 5,544,781

DATED : August 13, 1996

INVENTOR(S) : H. Mattesky

It is certified that error appears in the above-indentified patent and that said Letters Patent is hereby corrected as shown below:

In Claim 1, column 5, line 28, following the word "bottom", insert --,--.

In Claim 2, column 5, line 38, following the word "plurality", insert --of--; in line 40 following the word "said", change "point" to --joint--.

Signed and Sealed this

Twenty-ninth Day of October 1996

*Attest:*

Bruce Lehman

BRUCE LEHMAN

*Attesting Officer*

*Commissioner of Patents and Trademarks*